US007633464B2

(12) United States Patent
Mima et al.

(10) Patent No.: US 7,633,464 B2
(45) Date of Patent: Dec. 15, 2009

(54) METHOD FOR DRIVING PLASMA DISPLAY PANEL

(75) Inventors: Kunihiro Mima, Kyoto (JP); Masanori Kimura, Osaka (JP); Teiichi Kimura, Hyogo (JP)

(73) Assignee: Panasonic Corporation, Osaka (JP)

( * ) Notice: Subject to any disclaimer, the term of this patent is extended or adjusted under 35 U.S.C. 154(b) by 334 days.

(21) Appl. No.: 10/559,728

(22) PCT Filed: May 24, 2005

(86) PCT No.: PCT/JP2005/009834

§ 371 (c)(1),
(2), (4) Date: Dec. 7, 2005

(87) PCT Pub. No.: WO2005/114626

PCT Pub. Date: Dec. 1, 2005

(65) Prior Publication Data

US 2007/0097031 A1 May 3, 2007

(30) Foreign Application Priority Data

May 24, 2004 (JP) ..... 2004-152802

(51) Int. Cl.
*G09G 3/28* (2006.01)

(52) U.S. Cl. ..... 345/60; 315/169.4

(58) Field of Classification Search ..... 345/60, 345/63–72; 315/169.4
See application file for complete search history.

(56) References Cited

U.S. PATENT DOCUMENTS 5,142,200 A * 8/1992 Yamamoto et al. ..... 315/169.4
5,670,974 A * 9/1997 Ohba et al. ..... 345/60
5,745,086 A * 4/1998 Weber ..... 345/63
6,426,732 B1 7/2002 Makino
6,466,186 B1 * 10/2002 Shimizu et al. ..... 345/60
6,778,153 B2 * 8/2004 Kang ..... 345/60

(Continued)

FOREIGN PATENT DOCUMENTS

JP 11-65514 3/1999

(Continued)

OTHER PUBLICATIONS

Machine Translation of JP-2003-323150.*

*Primary Examiner*—Alexander Eisen
*Assistant Examiner*—Jason M Mandeville
(74) *Attorney, Agent, or Firm*—Wenderoth, Lind & Ponack, L.L.P.

(57) ABSTRACT

Driving a plasma display panel, in which generation of a region having brightness non-uniformity can be reduced over an entire screen without changing the voltage and pulse width of sustain pulses, to enable suppression of an increase in power consumption. This driving of the plasma display panel comprises (i) an initialization period for forming a discharge cell at an intersection where a scan electrode and a sustain electrode meet a data electrode and generating initialization discharge in the cell, (ii) a writing period for generating writing discharge in the discharge cell, and (iii) a sustain period for generating sustain discharge by alternately applying sustain pulses to the scan electrode and sustain electrode of the discharge cell. The rise time of the sustain pulses applied to the scan electrode and sustain electrode during the sustain period is shortened at a frequency of once every several times.

3 Claims, 4 Drawing Sheets

U.S. PATENT DOCUMENTS

| | | | | |
|---|---|---|---|---|
| 6,922,191 | B2 * | 7/2005 | Watanabe | 345/211 |
| 6,989,828 | B2 * | 1/2006 | Correa et al. | 345/211 |
| 7,050,022 | B2 * | 5/2006 | Kigo et al. | 345/66 |
| 7,187,346 | B2 * | 3/2007 | Kang et al. | 345/60 |
| 2001/0005188 | A1 * | 6/2001 | Watanabe | 345/60 |
| 2004/0021657 | A1 * | 2/2004 | Kang et al. | 345/204 |
| 2006/0077130 | A1 * | 4/2006 | Rhee | 345/60 |
| 2006/0109213 | A1 * | 5/2006 | Chae et al. | 345/67 |
| 2006/0145957 | A1 * | 7/2006 | Kim et al. | 345/67 |
| 2006/0152447 | A1 * | 7/2006 | Rhee | 345/67 |

FOREIGN PATENT DOCUMENTS

| | | |
|---|---|---|
| JP | 11-65523 | 3/1999 |
| JP | 2002-351396 | 12/2002 |
| JP | 2003-323150 | 11/2003 |

* cited by examiner

METHOD FOR DRIVING PLASMA DISPLAY PANEL

BACKGROUND OF THE INVENTION

1. Field of the Invention

The present invention relates to a method for driving plasma display panels.

2. Description of the Related Art

In a surface discharge AC type panel that typifies plasma display panels (hereinafter abbreviated as "panel"), a number of discharge cells are formed between an oppositely disposed front panel and a rear panel. On the front panel, two or more pairs of display electrodes comprising a scan electrode and a sustain electrode are formed in parallel on a front glass substrate. Further, on the front panel, a dielectric layer and a protective layer are formed in a manner covering the display electrodes. On the rear panel, two or more parallel data electrodes are formed on a rear glass substrate and a dielectric layer is formed covering the data electrodes. In addition, two or more barrier ribs are formed on top of the dielectric layer in parallel to the data electrodes. In addition, a phosphor layer is formed on the surface of the dielectric layer and the sides of the barrier ribs.

The front panel and the rear panel are oppositely disposed and sealed in a manner such that the display electrodes and the data electrodes make a two-level crossing, and a discharge gas is filled in the inner discharge space. Discharge cells are formed on the sections where the display electrodes and the date electrodes face each other in this way. In a panel having such a structure, ultraviolet ray is generated by gas discharge in each of the discharge cells. Color display is enabled by excitation emission of each of Red (R), Green (G) and Blue (B) phosphors with the ultraviolet ray.

As a method for driving a panel, the sub-field method is generally employed. In this method, the period of one field is divided into plural sub-fields and half-tone expression is performed by the combination of the sub-fields to be fired. Among sub-field methods, a drive method in which contrast ratio is improved by reducing the emission of light which is not related to half tone expression is reduced as much as possible is disclosed in Japanese Patent Unexamined Publication No. 2002-351396.

A brief description of the sub-field method is given below. Each of the sub-fields has an initialization period, a writing period and a sustain period. First, in the initialization period, initialization discharge simultaneously takes place in all discharge cells and erases hysteresis of earlier wall charges existing in the individual discharge cells, and wall charges necessary for subsequent writing action are formed. In addition, a priming (a detonator for discharge or an excitation particle) for decreasing a delay in discharge and stably generating writing discharge is generated.

During the subsequent writing period, scanning pulses are sequentially applied to the scan electrodes while applying to the data electrodes writing pulses corresponding to the image signal to be displayed. Selective writing discharge is thus generated between the scan electrodes and data electrodes thereby selectively forming wall charges. During the sustain period, a predetermined number of sustain pulses corresponding to brightness weight are alternately applied to the scan electrodes and sustain electrodes to selectively discharge the discharge cells in which wall charges have been formed by writing discharge thus causing light emission.

In such a panel of conventional method, dispersion of discharge timing occurs from discharge cell to discharge cell depending on the status of display. As a result, the emission intensity may vary from discharge cell to discharge cell and a screen having a region of brightness non-uniformity may be produced.

BRIEF SUMMARY OF THE INVENTION

It is an object of the present invention to prevent deterioration of display quality due to non-uniformity of brightness without increasing power consumption.

In the method for driving a plasma display panel of the present invention, discharge cells are formed at the intersections where the scan electrodes and sustain electrodes meet with the data electrodes. The method has an initialization period, a writing period and a sustain period. The initialization period is a period in which initialization discharge is generated in the discharge cells. The writing period is a period in which writing discharge is generated in the discharge cells. The sustain period is a period in which sustain discharge is generated by alternately applying sustain pulses to the scan electrode and sustain electrode of a discharge cell. The rise time of the sustain pulses to be applied to the scan electrode and sustain electrode during the sustain period is shortened at a frequency of once every several times.

Also, in the present invention, the rise time of the sustain pulses to be applied to the scan electrode and sustain electrode during the sustain period is shortened at a frequency of once every three times or once every two times.

According to the above-described method, it is possible to reduce generation of non-uniform brightness regions on a screen without changing the voltage and pulse width of the sustain pulses thus suppressing an increase in the power consumption.

DETAILED DESCRIPTION OF THE INVENTION

A description of the method for driving a plasma display panel of the present invention is given with reference to drawings.

Figure 1:
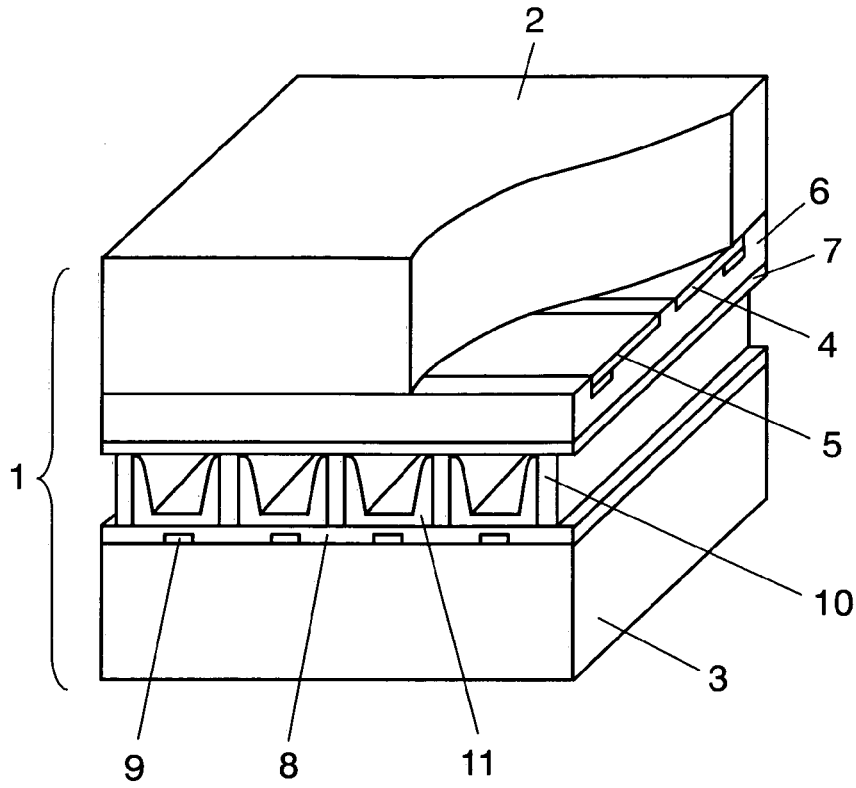
FIG. 1 is a perspective view of a key part of a panel used in a preferred embodiment of the present invention.

FIG. 1 is a perspective view showing a key part of a panel used in a preferred embodiment of the present invention. Panel 1 is structured by oppositely disposing front glass substrate 2 and rear glass substrate 3 in a manner such that a discharge space is formed therebetween. When viewed from the side of the front substrate 2, a plurality of scan electrodes 4 and sustain electrodes 5 that constitute a display electrode are formed on the front substrate 2 in pairs and are arranged in parallel to each other. Dielectric layer 6 is formed in a manner covering scan electrodes 4 and sustain electrodes 5. In addition, protective layer 7 is formed on top of dielectric layer 6.

A plurality of data electrodes 9 covered with insulating layer 8 are provided on rear substrate 3 and barrier ribs 10 are provided in parallel to the data electrodes 9 the on insulating layer 8 between adjacent data electrodes 9. Phosphor 11 is provided on the surface of insulating layer 8 and on the sides of barrier ribs 10. Front substrate 2 and rear substrate 3 are oppositely disposed in the direction in which scan electrode 4 and sustain electrode 5 cross data electrode 9. A mixture of neon and xenon, for example, is filled as a discharge gas in the discharge space formed between the two substrates.

Figure 2:
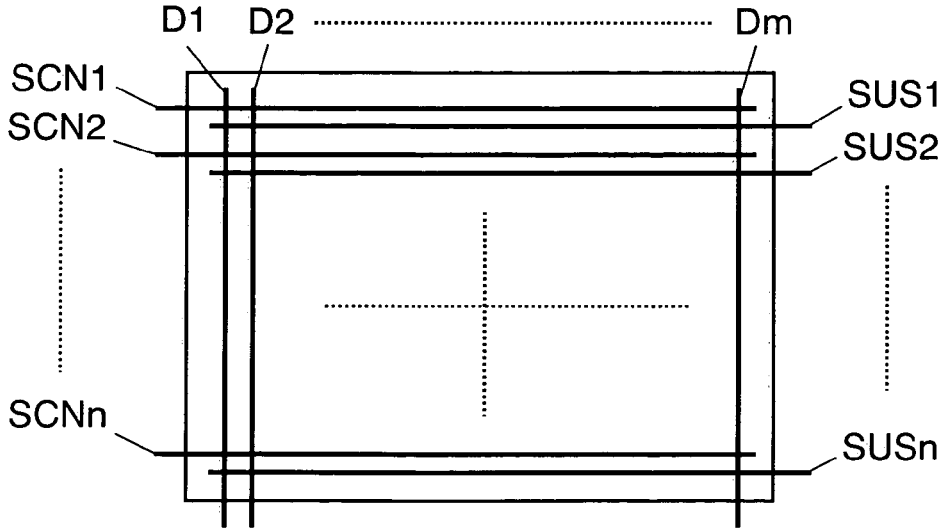
FIG. 2 is a diagram showing electrode layout of the panel.

FIG. 2 is a diagram showing electrode layout of a panel in a preferred embodiment of the present invention. In the direction of the lines, n pieces of scan electrodes SCN1 to SCNn (scan electrode 4 in FIG. 1) and n pieces of sustain electrodes SUS1 to SUSn (sustain electrode 5 in FIG. 1) are alternately arranged. In the direction of the rows, m pieces of data electrodes D1 to Dm (data electrode 9 in FIG. 1) are arranged. A discharge cell is formed at the intersection at which a pair of scan electrode SCNi and sustain electrode SUSi (i=1 to n) meet a data electrode Dj (j=1 to m), and m×n pieces of discharge cells are formed in the discharge space.

Figure 3:
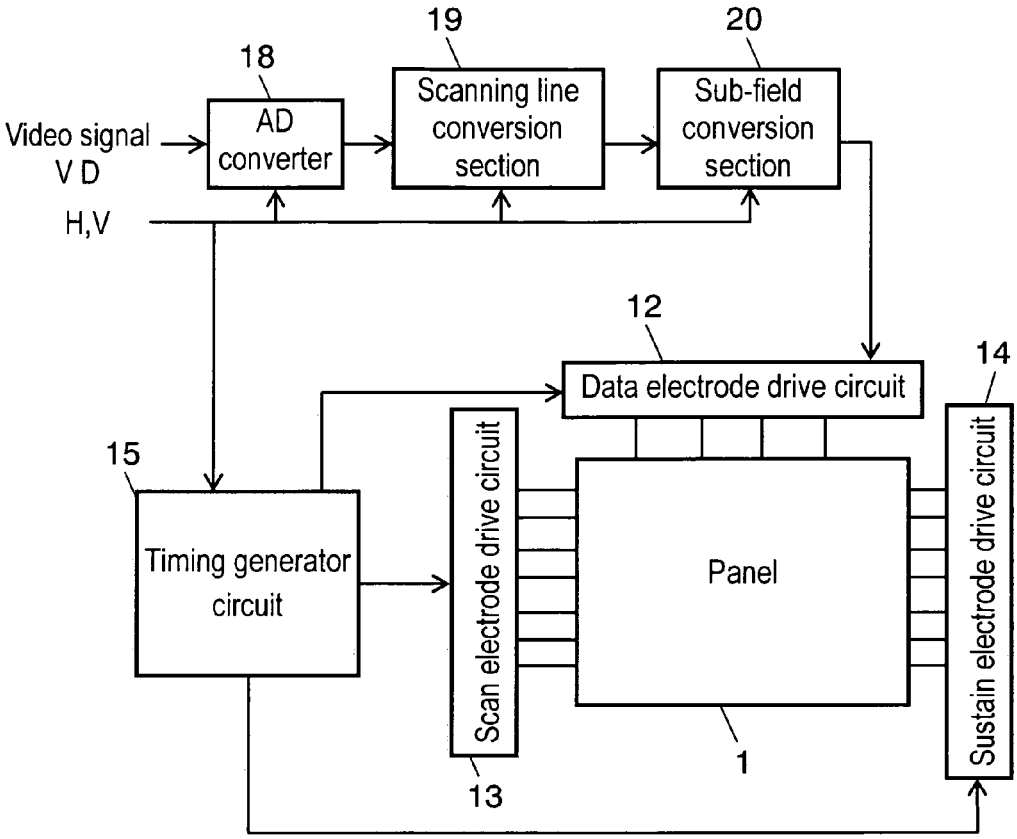
FIG. 3 is a block diagram of a plasma display device that employs a panel driving method of a preferred embodiment of the present invention.

FIG. 3 is a block diagram of a plasma display device that employs the panel driving method in a preferred embodiment of the present invention. The plasma display device includes panel 1, data electrode drive circuit 12, scan electrode drive circuit 13, sustain electrode drive circuit 14, timing generator circuit 15, AD converter 18, scanning line conversion section 19, sub-field conversion section 20, and a power supply circuit (not shown).

In FIG. 3, video signal VD is supplied to AD converter 18. Also, horizontal synchronizing signal H and vertical synchronizing signal V are supplied to timing generator circuit 15, AD converter 18, scanning line conversion section 19, and sub-field conversion section 20. AD converter 18 converts video signal VD into picture data in the form of digital signal and supplies the picture data to scanning line conversion section 19.

Scanning line conversion section 19 converts the picture data into picture data that correspond to the number of pixels of panel 1 and supplies the data to sub-field conversion section 20. Sub-field conversion section 20 divides the picture data of each pixel into plural bits corresponding to plural sub-fields and outputs picture data of each sub-field to data electrode drive circuit 12. Data electrode drive circuit 12 converts picture data of each sub-field into a signal corresponding to each of the data electrodes D1 to Dm and drives each data electrode.

Timing generator circuit 15 generates timing signals based on horizontal synchronizing signal H and vertical synchronizing signal V and supplies the timing signals to scan electrode drive circuit 13 and sustain electrode drive circuit 14. Scan electrode drive circuit 13 supplies driving voltage to scan electrodes SCN1 to SCNn based on the timing signal. Sustain electrode drive circuit 14 supplies driving voltage to sustain electrodes SUS1 to SUSn based on the timing signal.

Next, a description of the driving voltage for driving the panel and its action is given.

Figure 4:
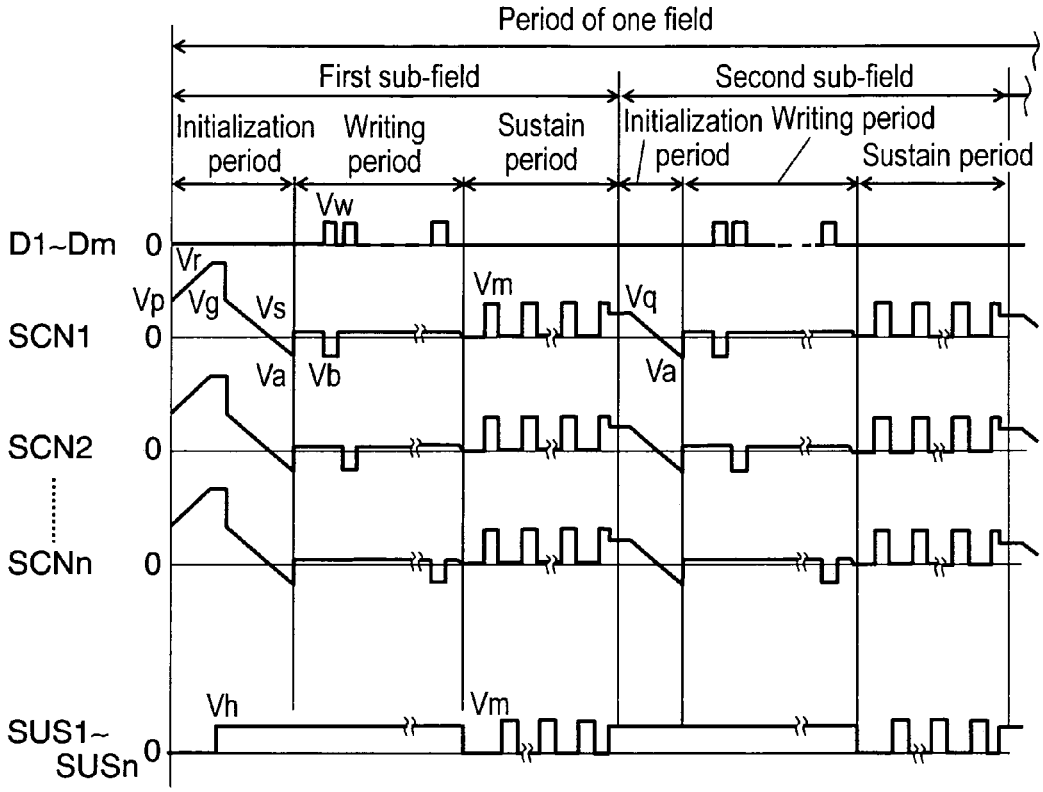
FIG. 4 is a diagram showing a waveform of the voltage applied to each electrode of a panel in a preferred embodiment of the present invention.

FIG. 4 is a diagram showing the waveform of the driving voltage to be applied to each electrode of a plasma display panel in a preferred embodiment of the present invention. The diagram also shows the waveform of the driving voltage in a sub-field having an initialization period for initializing all the cells (hereinafter referred to as "all-cell initialization sub-field") and in a sub-field having an initialization period for initializing selected cells (hereinafter referred to as "selective initialization sub-field").

First, a description is given on the driving voltage waveform of the all-cell initialization sub-field and its action. In FIG. 4, in the initialization period, a ramp voltage that gradually increases from a voltage Vp (V) smaller than the firing voltage toward a voltage Vr (V) greater than the firing voltage is applied to scan electrodes SCN1 to SCNn while maintaining data electrodes D1 to Dm and sustain electrodes SUS1 to SUSn at 0 volt. With this, the first weak initialization discharge takes place in all the discharge cells and, at the same time, negative wall voltages are built up on scan electrodes SCN1 to SCNn while positive wall voltages are built up on sustain electrodes SUS1 to SUSn and on data electrodes D1 to Dm. Here, the wall voltages on electrodes mean voltages generated by wall charges built up on the dielectric layer or phosphor layer that covers the electrodes.

Subsequently, a gradually decreasing ramp voltage that decreases from a voltage Vg (V) toward a voltage Va (V) is applied to scan electrodes SCN1 to SCNn while maintaining sustain electrodes SUS1 to SUSn at a positive voltage Vh (V). As a result, the second weak initialization discharge takes place in all the discharge cells, the wall voltages on scan electrodes SCN1 to SCNn and the wall voltages on sustain electrodes SUS1 to SUSn are weakened, and the wall voltages on data electrodes D1 to Dm are also adjusted to a value adequate for writing action. In short, the initialization action in the all-cell initialization sub-field is an all-cell initialization action to cause initialization discharge in all the cells.

In the subsequent writing period, scan electrodes SCN1 to SCNn are once maintained at voltage Vs (V) as shown in FIG. 4. Then, a positive writing pulse voltage Vw (V) is applied to data electrode Dk out of data electrodes D1 to Dm of the discharge cells to be displayed in the first line while applying a scanning pulse voltage Vb (V) to scan electrode SCN 1 on the first line. At this time, the voltage at the intersection of data electrode Dk and scan electrode SCN1 is the sum of the externally applied voltage (Vw−Vb), the wall voltage on data electrode Dk and the wall voltage on scan electrode SCN1, and is greater than the firing voltage.

Subsequently, writing discharge takes place between data electrode Dk and scan electrode SCN1 and between sustain electrode SUS1 and scan electrode SCN1, a positive wall voltage is stored on scan electrode SCN1 of this discharge cell, a negative wall voltage is stored on sustain electrode SUS1, and a negative wall voltage is also stored on data electrode Dk. In this way, writing action of storing wall voltage on each electrode is performed by generating writing discharge in the discharge cells to be displayed on the first line. On the other hand, as the voltage at the intersection of the data electrode to which no positive writing pulse voltage Vw (V) is applied and scan electrode SCN1 does not exceed the firing voltage, no writing discharge takes place. The writing period ends after sequentially performing the above writing action until the discharge cells on the n-th line are reached.

In the subsequent sustain period, as shown in FIG. 4, sustain electrodes SUS1 to SUSn are first returned to 0 (V) and a positive sustain pulse voltage Vm (V) is applied to scan electrodes SCN1 to SCNn. During this process, in the discharge cell in which writing discharge took place, the voltage across scan electrode SCNi and sustain electrode SUSi is the sum of sustain pulse voltage Vm (V) and the wall voltages of scan electrode SCNi and sustain electrode SUSi and exceeds the firing voltage.

Subsequently, sustain discharge takes place between scan electrode SCNi and sustain electrode SUSi, and a negative wall voltage is stored on scan electrode SCNi while a positive wall voltage is stored on sustain electrode SUSi. During this process, a positive wall voltage is also stored on data electrode Dk. In the discharge cells in which no writing discharge took place during the writing period, no sustain discharge takes place and the state of the wall voltage at the end of the initialization period is maintained. Subsequently, scan electrodes SUS1 to SUSn are returned to 0 (V) and a positive sustain pulse voltage Vm (V) is applied to sustain electrodes SUS1 to SUSn.

Then, in the discharge cells in which sustain discharge took place, as the voltage across sustain electrode SUSi and scan electrode SCNi exceeds the firing voltage, sustain discharge takes place again between sustain electrode SUSi and scan electrode SCNi and a negative wall voltage is stored on sustain electrode SUSi while a positive wall voltage is stored on scan electrode SCNi. Likewise, by subsequently alternately applying sustain pulses to scan electrodes SCN1 to SCNn and sustain electrodes SUS1 to SUSn, sustain discharge continues to take place in the discharge cells in which writing discharge took place during the writing period.

In the meantime, the wall voltages on scan electrodes SCN1 to SCNn and sustain electrodes SUS1 to SUSn are removed by applying, at the end of the sustain period, so-called narrow width pulses across scan electrodes SCN1 to SCNn and sustain electrodes SUS1 to SUSn while leaving the positive wall charges on data electrode Dk. In this way, sustain action during the sustain period ends.

Next, a description of the drive voltage waveform and its action during the selective initialization sub-field is given. During the selective initialization period, sustain electrodes SUS1 to SUSn are maintained at Vh (V), data electrodes D1 to Dm are maintained at 0 (V), and a ramp voltage that gradually decreases from Vq (V) toward Va (V) is applied to scan electrodes SCN1 to SCNn. Then, weak initialization discharge takes place in the discharge cells in which sustain discharge took place during the sustain period of the preceding sub-field thus weakening the wall voltages on scan electrode SCNi and sustain electrode SUSi and the wall voltage on data electrode Dk is adjusted to a value adequate for writing action.

On the other hand, no discharge takes place in the discharge cells in which no writing discharge or sustain discharge took place in the preceding sub-field, and the state of wall charges at the end of the initialization period in the preceding sub-field is maintained as is. In short, the initialization action in the selective initialization sub-field is an action of selective initialization by generating initialization discharge in the discharge cells in which sustain discharge took place in the preceding sub-field.

In the subsequent writing period and sustain period, by performing action similar to the action during the above-described writing period and sustain period of the all-cell initialization sub-field, light emission corresponding to an input video signal is enabled.

By the way, in a plasma display panel, there occurs dispersion from discharge cell to discharge cell in the timing at which discharge takes place depending on the state of display. As a result, there appears a region on the screen where brightness is non-uniform. This phenomenon of brightness non-uniformity is promoted by the voltage applied to the scan electrodes and sustain electrodes during the above-mentioned sustain period and by the distortion of waveform due to discharge current during sustain discharge.

Also, as part of an effort for increasing brightness of panels, the partial pressure of xenon used as the discharge gas is recently increased. When brightness is enhanced in this way, the above-mentioned brightness non-uniformity becomes all the more prominent.

Figure 5:
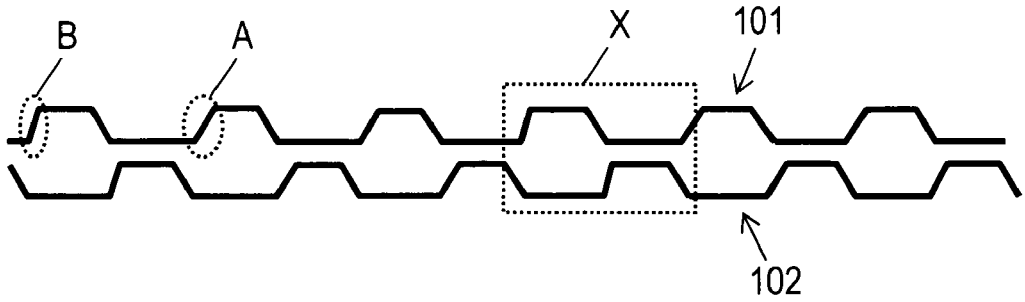
FIG. 5 is a diagram showing an example waveform of a sustain pulses in accordance with the present invention.
Figure 6:
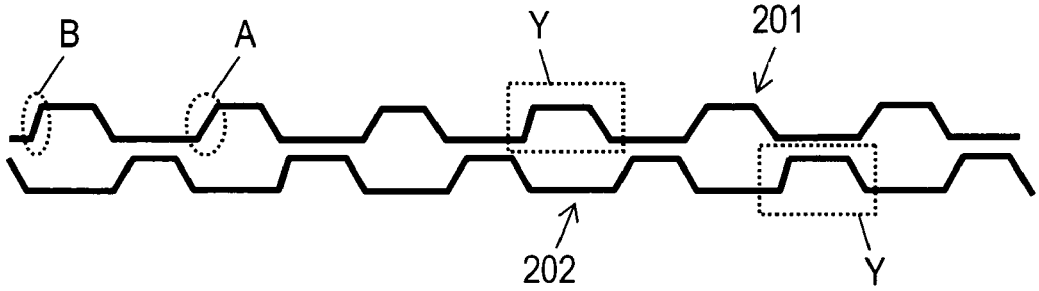
FIG. 6 is a diagram showing another example waveform of sustain pulses in accordance with the present invention.

Accordingly, in the present invention, rise time of sustain pulses to be applied to scan electrodes and sustain electrodes during the sustain period is shortened at a frequency of once every several times so as to suppress dispersion of timing at which discharge takes place in each discharge cell at the time of sustain discharge. FIG. 5 and FIG. 6 show examples.

FIG. 5 and FIG. 6 show enlarged views of key parts of the sustain pulses to be applied to scan electrodes and sustain electrodes during the sustain period shown in FIG. 4. Sustain pulses 101, 201 are the pulses to be applied to the scan electrodes. Sustain pulses 102, 202 are sustain pulses to be applied to the sustain electrodes.

Also, the example shown in FIG. 5 is one in which changes in the rise time of the sustain pulses to be applied to the scan electrodes and sustain electrodes are done at the same timing as shown in section X while the example shown in FIG. 6 is one in which changes are made at different timing as shown in section Y. In FIG. 5 and FIG. 6, section A is a period of normal rise time set at about 550 ns. Section B is a period of a shorter rise time than section A and set at about 400 ns in the present invention.

As shown in FIG. 5 and FIG. 6, according to the present invention, the rise time of the sustain pulses to be applied to the scan electrodes and sustain electrodes during the sustain period is shortened at a frequency of once every several times thereby to suppress dispersion of discharge timing of each discharge cell at the time of sustain discharge. Here, several times does not mean a fixed number of times, rather it may be switched, for example, between once in a certain number of times and once in a different number of times.

In addition, by shortening the rise time of the sustain pulses to be applied to the scan electrodes and sustain electrodes during the sustain period at a frequency of once every three times or once every two times, the dispersion of timing at which discharge takes place in each discharge cell at the time of sustain discharge may be further suppressed. Shortening of the rise time of the sustain pulses is realized by controlling the timing of action of an energy recovery circuit installed in the scan electrode drive circuit and the sustain electrode drive circuit. To put it concretely, while the energy recovery circuit first supplies electric power to the panel at the time of rising of the sustain pulses through an inductor and subsequently supplies electric power through a low-impedance power supply, it is possible to make the rising of sustain pulses steep by advancing the timing of supplying electric power from a low-impedance power supply. Shortening of the rise time may also be easily realized by changing inductance of the energy recovery circuit.

As is described above, the method for driving a plasma display panel of the present invention prevents deterioration of display quality due to brightness non-uniformity without increasing power consumption and is useful for picture display devices that use a plasma display panel.

REFERENCE NUMERALS IN THE DRAWINGS

1 Plasma display panel
2 Front substrate
3 Rear substrate
4 Scan electrode
5 Sustain electrode
9 Data electrode
13 Scan electrode drive circuit
14 Sustain electrode drive circuit

The invention claimed is:

1. A method for driving a plasma display panel having a scan electrode, a sustain electrode and a data electrode forming a discharge cell at a point of intersection therebetween, said method for driving the plasma display panel comprising:

generating, during an initialization period, an initialization discharge in the discharge cell;

generating, during a writing period, a writing discharge in the discharge cell; and generating, during a sustain period, a sustain discharge by alternately applying sustain pulses to the scan electrode and sustain electrode of the discharge cell, wherein a rise time of a sustain pulse applied to the scan electrode during the sustain period is shortened at a frequency of once every three times a sustain pulse is applied thereto, wherein the sustain pulse having the shortened rise time that is applied to the scan electrode has a shortest rise time from among the sustain pulses applied to the scan electrode during the sustain period, wherein a rise time of a sustain pulse applied to the sustain electrode during the sustain period is shortened at a frequency of once every three times a sustain pulse is applied thereto, wherein the sustain pulse having the shortened rise time that is applied to the sustain electrode has a shortest rise time from among the sustain pulses applied to the sustain electrode during the sustain period, wherein sustain pulses, applied to the scan electrode and the sustain electrode between the sustain pulses having the shortened rise time, have a non-shortened rise time that is longer than the shortened rise time, wherein a rise time of each of the sustain pulses having the non-shortened rise time is the same, and wherein a plurality of sustain pulses having the shortened rise time are applied to the scan electrode and the sustain electrode during the sustain period.

2. The method of driving a plasma display panel according to claim 1, wherein a time delay exists between applying the sustain pulse having the shortened rise time to the scan electrode and applying the sustain pulse having the shortened rise time to the sustain electrode, the time delay causing the sustain pulse having the shortened rise time to be applied to the sustain electrode only after a falling edge of the sustain pulse having the shortened rise time has occurred on the scan electrode and a rising edge of a sustain pulse having a non-shortened rise time has occurred on the scan electrode.

3. A method for driving a plasma display panel having a scan electrode, a sustain electrode and a data electrode forming a discharge cell at a point of intersection therebetween, said method for driving the plasma display panel comprising:

generating, during an initialization period, an initialization discharge in the discharge cell;

generating, during a writing period, a writing discharge in the discharge cell; and generating, during a sustain period, a sustain discharge by alternately applying sustain pulses to the scan electrode and sustain electrode of the discharge cell, wherein a rise time of a sustain pulse applied to the scan electrode during the sustain period is shortened at a frequency of one of (i) once every two times and (ii) once every three times, a sustain pulse is applied thereto, wherein the sustain pulse having the shortened rise time that is applied to the scan electrode has a shortest rise time from among the sustain pulses applied to the scan electrode during the sustain period, wherein a rise time of a sustain pulse applied to the sustain electrode during the sustain period is shortened at a frequency of one of (i) once every two times and (ii) once every three times, a sustain pulse is applied thereto, wherein the sustain pulse having the shortened rise time that is applied to the sustain electrode has a shortest rise time from among the sustain pulses applied to the sustain electrode during the sustain period, wherein sustain pulses, applied to the scan electrode and the sustain electrode between the sustain pulses having the shortened rise time, have a non-shortened rise time that is longer than the shortened rise time, wherein a rise time of each of the sustain pulses having the non-shortened rise time is the same, and wherein a plurality of sustain pulses having the shortened rise time are applied to the scan electrode and the sustain electrode during the sustain period.

* * * * *